US005507596A

United States Patent [19]

Bostelman et al.

[11] Patent Number: 5,507,596

[45] Date of Patent: Apr. 16, 1996

[54] UNDERWATER WORK PLATFORM SUPPORT SYSTEM

[75] Inventors: Roger V. Bostelman, Frederick; James S. Albus, Kensington, both of Md.; Andrew M. Watt, Slidell, La.

[73] Assignee: The United States of America as represented by The Secretary of Commerce, Washington, D.C.

[21] Appl. No.: 136,204

[22] Filed: Oct. 15, 1993

[51] Int. Cl.[6] ..... E02D 23/08; E02B 17/02

[52] U.S. Cl. ..... 405/191; 405/188; 405/195.1; 166/355

[58] Field of Search ..... 405/195.1, 209, 405/203, 196, 188, 191, 192; 166/355, 365, 338; 212/190–194

[56] References Cited

U.S. PATENT DOCUMENTS

| | | | |
|---|---|---|---|
| 2,293,936 | 8/1942 | Crooke | 212/190 X |
| 4,076,127 | 2/1978 | Hupkes | 212/190 |
| 4,121,806 | 10/1978 | Iato et al. | 166/355 |
| 4,146,345 | 3/1979 | Silvestri | 405/188 X |
| 4,556,341 | 12/1985 | Ayers | 405/195.1 |
| 4,666,362 | 5/1987 | Landsberger et al. | 414/735 |
| 4,819,730 | 4/1989 | Williford et al. | 166/359 X |
| 4,858,694 | 8/1989 | Johnson et al. | 166/355 |
| 4,883,184 | 11/1989 | Albus | 212/146 |
| 5,069,580 | 12/1991 | Herwig et al. | 405/188 X |
| 5,190,107 | 3/1993 | Langner et al. | 166/355 |
| 5,209,302 | 5/1993 | Robichaux et al. | 166/355 |

OTHER PUBLICATIONS

Dagalakis, N. G., et al., "Robot Crane Technology" (Final Report), NIST Technical Note 1267, 60 pp., Jul. 1989.

Dagalakis, N. G., et al., "Stiffness Study of . . . for Shipbuilding Applications", Journal of Offshort Mechanics and Arctig Engg., vol. 111, 183–193, Aug. 1989.

Unger, Joseph, et al., "Optimum Stiffness Study . . . Under Horizontal Force", Natl. Bureau of Standards, 10 pp. (1988).

Albus, J., et al., "The NIST Robocrane", Journal of Robotic Systems 10(5), 709–724 (1993).

Stewart, D., "A Platform With Six Degrees of Freedom", Proc Instn Mech Engrs, vol. 180 Pt 1 No. 15 (1965–66).

Landsberger, S. E., "Design and Construction . . . Parallel Link Manipulator", Massachusetts Inst. of Tech., 122 pp., Sep. 1984.

Sheridan, T. B., "Human Supervisory Control of Robot Systems", Massachusetts Inst. of Tech., pp. 808–812. (1986).

Boswell, L. F., "Platform Superstructures: Design and Construction", Granata Publishing Ltd., pp. 145–166 (1984).

*Primary Examiner*—Dennis L. Taylor
*Attorney, Agent, or Firm*—Leydig, Voit & Mayer

[57] ABSTRACT

A support system for supporting an underwater work platform includes a work platform submerged in a body of water and a support structure supported by the body of water above the work platform. The work platform is supported by a plurality of cables connected between the support structure and the work platform. Motions of the support structure in the body of water are sensed, and the length of the cables is adjusted in response to the sensed motions of the support structure so that the work platform can be maintained stationary even when the support structure is subjected to wave forces and currents.

46 Claims, 6 Drawing Sheets

UNDERWATER WORK PLATFORM SUPPORT SYSTEM

BACKGROUND OF THE INVENTION

This invention relates to a system for supporting a work platform in a desired position underwater. More particularly, it relates to a system which can stably support an underwater work platform when the support system itself is undergoing motion.

Various methods are used for supporting equipment underwater while performing operations such as pipe laying and repair, cable installation, and salvage work. These include suspending the equipment from a surface vessel by means of a crane using a single cable, supporting the equipment on a legged structure mounted on the sea bottom, and mounting the equipment on a submersible. However, each of these methods has severe limitations. Equipment supported by a crane from a surface vessel is subjected to all the motions that the surface vessel undergoes, so it is difficult to control the position of the equipment. A legged structure mounted on the sea bottom can provide stable support for underwater equipment, but the legged structure will normally disturb the sea bottom, creating turbulence that hampers underwater operations and possibly damaging the work site. Furthermore, the depth of the water in which legged structures can be employed is limited. Submersibles have great dexterity and mobility, but they are expensive to manufacture and have a small payload to weight ratio.

Accordingly, there is a need for a support system capable of supporting equipment underwater in a stable manner. There is also a need for a support system that it economical to manufacture.

SUMMARY OF THE INVENTION

Accordingly, it is an object of the present invention to provide a support system for an underwater work platform which can stably support the work platform at a desired depth.

It is another object of the present invention to provide a support system for an underwater work platform which is economical to manufacture.

It is yet another object of the present invention to provide a method for supporting an underwater work platform in a stable manner.

A support system for supporting an underwater work platform according to one form of the present invention includes a work platform capable of being submerged in a body of water and a support structure supported by the body of water above the work platform. The work platform can be supported by a plurality of cables connected between the support structure and the work platform. Motion sensing means sense the motions of the support structure in the body of water, and the length of the cables is adjusted by a length adjusting means in response to the sensed motions of the support structure. The changes in the cable length compensate for the motions of the support structure and enable the work platform to be maintained stationary even when the support structure is moving in waves.

In accordance with another form of the present invention, a support system includes an underwater work platform and a support structure connected to the work platform by a plurality of cables. The tension of at least one of the cables is sensed, and the buoyancy of the work platform is adjusted in response to changes in the sensed tension.

A control method according to one form of the present invention comprises supporting a work platform submerged in a body of water by a plurality of cables connected between the work platform and a support structure floating in the body of water above the work platform, sensing motion of the support structure in the body of water, and adjusting the length of at least one of the cables in response to the sensed motion of the support structure.

A control method according to another form of the present invention comprises supporting a work platform submerged in a body of water by a plurality of cables connected between the work platform and a support structure disposed above the work platform, sensing a tension in at least one of the cables, and adjusting the buoyancy of the work platform in response to changes in the sensed tension.

The work platform can be used for performing a wide range of operations, including pipe or cable laying, gripping, fixturing, cutting, positioning, inspection, salvage, hoisting, seabed jetting, plowing for pipeline burial, and hull work on off-shore barges and ships.

DESCRIPTION OF THE PREFERRED EMBODIMENTS

Figure 1:
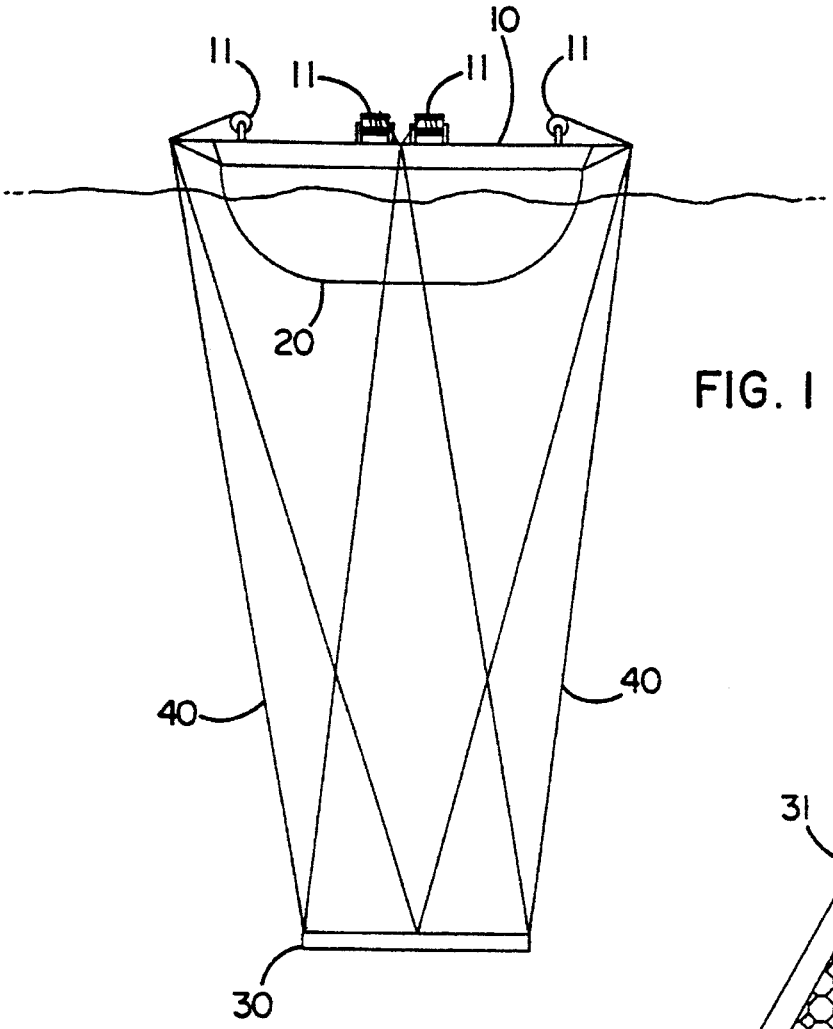
FIG. 1 is an elevation of a first embodiment of a support system according to the present invention.
Figure 3:
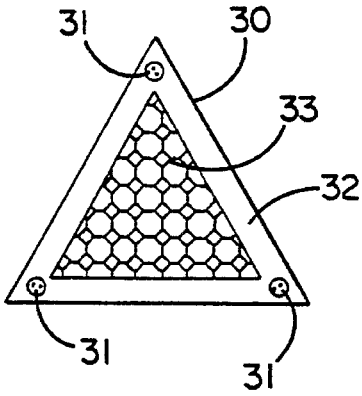
FIG. 3 is a plan view of the work platform of FIG. 1.
Figure 2:
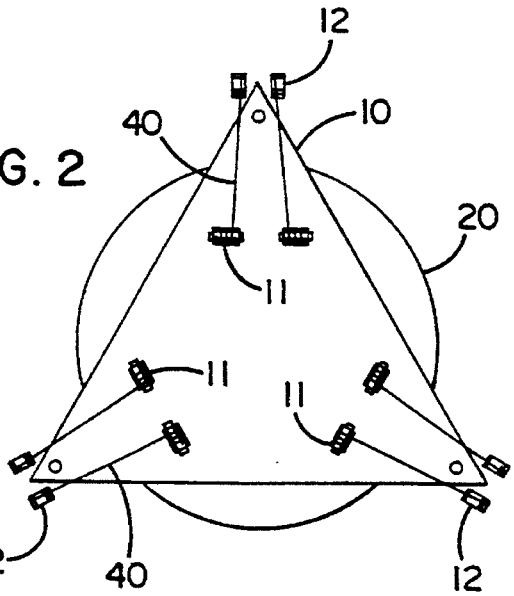
FIG. 2 is a plan view of the support platform of FIG. 1.

A number of preferred embodiments of a support system according to the present invention will be described while referring to the accompanying drawings, FIGS. 1–5 of which illustrate a first embodiment. As shown in these figures, a work platform 30 for use in performing underwater operations is supported in a submerged position beneath the surface of a body of water, such as an ocean or a lake, by a support structure comprising a support platform 10 and a surface vessel 20 on which the support platform 10 is mounted. The weight of the work platform 30 is transmitted to the support platform 10 by means of a plurality of cables 40 connected between the two platforms 10 and 30. The length of each cable 40 can be individually controlled by means of a corresponding winch 11 mounted on the support platform 10 connected to the cable 40.

The surface vessel 20 can be any type of vessel capable of bearing the weight of both platforms 10 and 30, such as a ship or a barge. In this embodiment, the surface vessel 20 is an omnidirectional barge having a circular hull which enables the surface vessel 20 to be easily maneuvered in any direction. The surface vessel 20 can be self-propelled, it can be maneuvered by means of another surface vessel, or it can also be maneuvered by a propulsion member mounted on the work platform 30.

A support system according to the present invention employs at least two cables 40 to support the work platform 30. The number of cables 40 which are used will depend on the number of degrees of freedom of control which are desired. For example, if only three degrees of freedom are required, the work platform 30 can be supported by three cables 40 connected to three individually controlled winches 11. The present embodiment is equipped with six cables 40 to enable the work platform 30 to be manipulated with six degrees of freedom. More than six cables 40 can also be employed, although in this case some of the cables 40 will be redundant from the standpoint of control.

Six individually controlled winches 11 are mounted atop the support platform 10, and one of the cables 40 is wound around each of the winches 11. In order to enable the winches 11 to be spaced from the periphery of the support platform 10, a plurality of pulleys 12 are mounted on the edges of the support platform 10, and each cable 40 passes over one of the pulleys 12. However, it is also possible to mount the winches 11 on the edges of the support platform 10 or on outriggers extending form the support platform 10 and omit the pulleys 12.

The support platform 10 can be a separate structure installed atop the deck of the surface vessel 20, or if the surface vessel 20 is of suitable shape, the support platform 10 may be a portion of the deck.

As can be seen in FIG. 1, at their upper ends, the cables 40 are grouped into three pairs, with the cables 40 of each pair converging towards each other at a support point. While it is not necessary to the operation of the invention for the cables 40 to be grouped in this manner, this arrangement provides maximum stiffness without the cables 40 crossing one another. In this embodiment, the support points for the upper ends of the cables 40 are disposed at the vertices of an equilateral triangle, and while a different arrangement of the support points can be employed, this arrangement is advantageous because it provides a greater stiffness. The support platform 10 can have any desired shape and need not be a triangle as in this embodiment.

The six cables 40 are connected to the work platform 30 at three support points 31. The support points 31 can be at the same or different heights with respect to the work platform 30, but in this embodiment, for simplicity, they are at the same height. Preferably, the support points 31 define a triangle when viewed in plan, and more preferably the triangle is an equilateral triangle. The triangle defined by the support points 31 (which will be referred to as the lower triangle) is oriented so that its corners point towards the legs of the triangle defined by the support points for the upper ends of the cables 40 (which will be referred to as the upper triangle). In other words, the lower triangle is rotated by 120 degrees about a vertical axis with respect to the upper triangle. The work platform 30 need not have any particular shape. In the present embodiment, it has a triangular frame defined by three pieces of hollow steel tubing 32 joined at their corners. In many cases, it is convenient if the work platform 30 is equipped with a deck 33 in order for supporting equipment, although the deck 33 is optional. Preferably, the deck 33 has openings formed in it through which water can flow so as to reduce the flow resistance of the work platform 30 as it is raised and lowered. In this embodiment, the deck 33 is constructed from perforated steel connected between the steel tubing 32.

The lower ends of the cables 40 are connected to the work platform 30 by suitable means such as eye hooks, U-bolts, or padeyes and shackles installed at the three support points 31 of the work platform 30. In order to prevent the cables 40 from twisting, swivel joints or similar devices which transmit only tensile forces may also be employed to connect the cables 40 to the work platform 30.

The stiffness of the connection formed by the cables 40 between the support platform 10 and the work platform cables 30 depends upon a number of parameters, including the distance between the platforms 10 and 30 the relative dimensions of the upper and lower triangles. In general, the higher the stiffness the better. When the dimensions of the upper triangle are larger than those of the lower triangle, as is usually the case, for a given distance between the platforms, the stiffness is a maximum when the dimensions of the upper triangle are twice those of the lower triangle.

When the work platform 30 is loaded with equipment, it is preferably negatively buoyant so that in its submerged state, all six cables 40 can be maintained in tension. In this embodiment, the work platform 30 is equipped with ballast tanks 34 for adjusting the buoyancy as well as the center of gravity of the work platform 30, whereby the tension in the cables 40 can be set to achieve a desired stiffness. The ballast tanks 34 can be filled with water to decrease the buoyancy of the work platform 30 or filled with air or other material which is lighter than water, such as helium, to displace the water and increase the buoyancy. The ratio of water to air in the ballast tanks 34 can be varied by remote control from aboard the support platform 10. Air is supplied to the ballast tanks 34 from a compressor 17 or other source of compressed air aboard the support platform 10. Alternatively, compressed air tanks can be installed aboard the work platform 30. A pressure sensor 18 is installed in the line between the compressor 17 and the ballast tanks 34 so that the ratio of air to water in each ballast tank 34 can be determined. When the frame of the work platform 30 is formed by hollow structural members such as steel tubing 32 with sealed ends, fittings for connection to the air line from the compressor 17 and remote control valves can be installed on the tubing 32 to permit the inflow and outflow of water and air, so that the insides of the tubing 32 can be used as the ballast tanks 34. By connecting a plurality of sections of the tubing 32 together in series and sealing the ends of each section prior to joining the sections, a plurality of ballast tanks 34 can be formed in each of the three sides of the work platform 30. Alternatively, the ballast tanks 34 can be inflatable bladders disposed inside the tubing 32. In this embodiment, the work platform 30 has positive buoyancy when the ballast tanks 34 are empty, i.e., full of air, so the work platform 30 is submerged by filling the ballast tanks 34.

Figure 4:
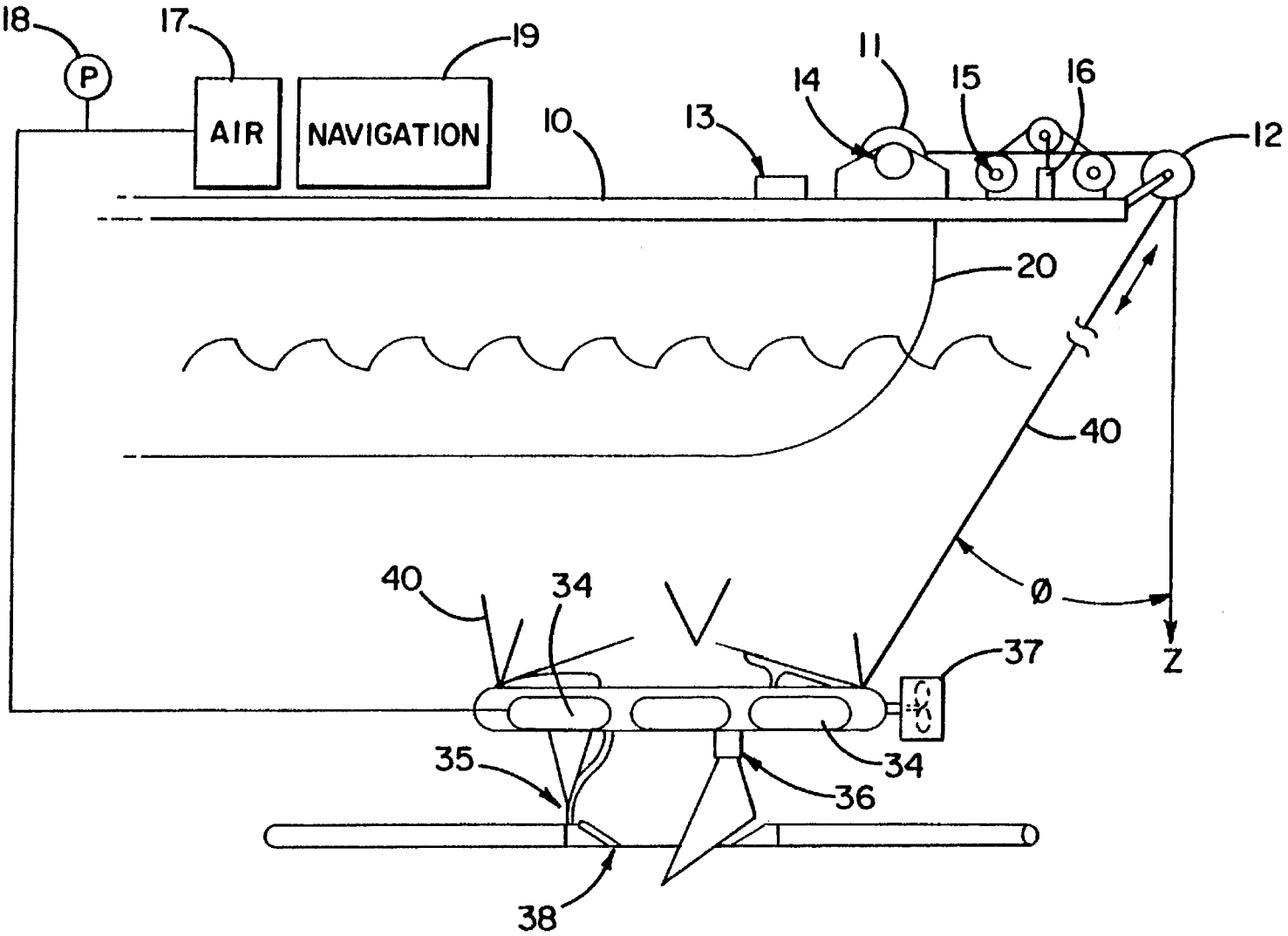
FIG. 4 is an elevation showing a portion of the embodiment of FIG. 1 while performing an underwater operation.

There are no limits to the types of equipment that can be supported on the work platform 30. FIG. 4 illustrates the work platform 30 being used to repair a collapsed section of underwater pipe 38. In this case, the work platform 30 is equipped with an abrasive water jet cutter 35 and a color imaging sonar device 36 which forms an image of the pipe 38 and transmits the image to unillustrated control equipment aboard the support platform 10. A few examples of other types of devices that can be supported by the work platform 30 are welding equipment, grippers, cutters, robot arms, drilling equipment, pipe laying equipment, and diving decompression chambers.

The work platform 30 can be moved to a desired location at a work site by operation of propulsion devices on the surface vessel 20 on which the support platform 10 is mounted, and horizontal movement of the surface vessel 20 along the surface is transmitted to the work platform 30 by the cables 40. However, if the surface vessel 20 is of relatively small displacement, the work platform 30 can be installed with propulsion devices such as thrusters 37, and the propulsive force applied by the thrusters 37 on the work platform 30 can be transmitted to the support platform 10 through the cables 40. This arrangement would allow divers to control the location of the work platform 30 from underwater.

As shown in FIG. 4, the support platform 10 is equipped with one or more motion sensors 13 which sense the motions of the support platform 10 in waves. The motion sensors 13 may include tilt sensors for sensing the angle of the support platform 10 in roll, pitch, and yaw, and they may include accelerometers for measuring accelerations of the support platform 10 in heave and surge. The velocity and displacement of the support platform 10 from a reference position can be determined by integrating the measured accelerations.

The tension of each cable 40 is sensed by a tension sensor 16, and the length of each cable 40 which has been paid out from the winches 11 is detected by suitable means. The present embodiment employs for each cable 40 both an absolute position sensor 14 and an incremental encoder 15 to measure the length of the cable 40. These devices are commercially available and are commonly used for measuring the displacements of moving objects such as cables. An example of the absolute position sensor 14 is a potentiometer-type sensor mounted on each winch 11 and having a wiper arm which moves as the winch 11 rotates. An example of the incremental encoder 15 is an optical sensor which detects movement of each cable 40 and generates two square wave output signals which are out of phase with one another. Based on the phase difference between the output signals, the direction of movement of each cable 40 can be determined, and by counting the pulses in the output signals, displacement of each cable 40 can be measured.

The support platform 10 can also be equipped with conventional navigation equipment 19, such as sonar, a global positioning system, or a sea bottom sensor for determining the position of the support platform 10 with respect to a reference location.

When all six cables 40 are in tension, the work platform 30 is kinematically constrained with respect to the support platform 10, and there is a known mathematical relationship between the lengths of the six cables 40 and the position and angular orientation of the work platform 30. Therefore, by controlling the winches 11 to vary the lengths of the cables 40, the position and angular orientation of the work platform 30 can be controlled with six degrees of freedom. For example, if all six cables 40 are simultaneously reeled out or in by the same amounts, the work platform 30 can be raised or lowered in the water while its angular orientation is maintained constant. Alternatively, if the lengths of different cables 40 are varied by different amounts, the work platform 30 can be made to roll, yaw, or pitch while its depth is maintained constant.

Similarly, when the surface vessel 20 is subjected to wave motions and the position and angular orientation of the support platform 10 are changing, the winches 11 can be controlled to vary the lengths of the cables 40 so as to compensate for the motions of the surface vessel 20 and maintain the position and angular orientation of the work platform 30 constant. For example, if the surface vessel 20 is undergoing simple heaving, the winches 11 can pay out the cables 40 during upwards motion of the support platform 10 and take in the cables 40 during downwards motion of the support platform 10, thereby compensating for the heaving motion of the surface vessel 20.

This embodiment includes a control system for controlling the position and the angular orientation of the work platform 30 by control of the winches 11 aboard the support platform 10 and/or the ballast tanks 34 aboard the work platform 30. The control system performs two functions. One function is to adjust the position and angular orientation of the work platform 30 in response to inputs from a human operator, such as input signals provided by the operation of a joy stick or a keyboard. Another function of the control system is to automatically compensate for movements of the support platform 10 as the surface vessel 20 moves in response to wave motions, currents, and winds and thereby maintain the work platform 30 in a stable position.

Figure 5:
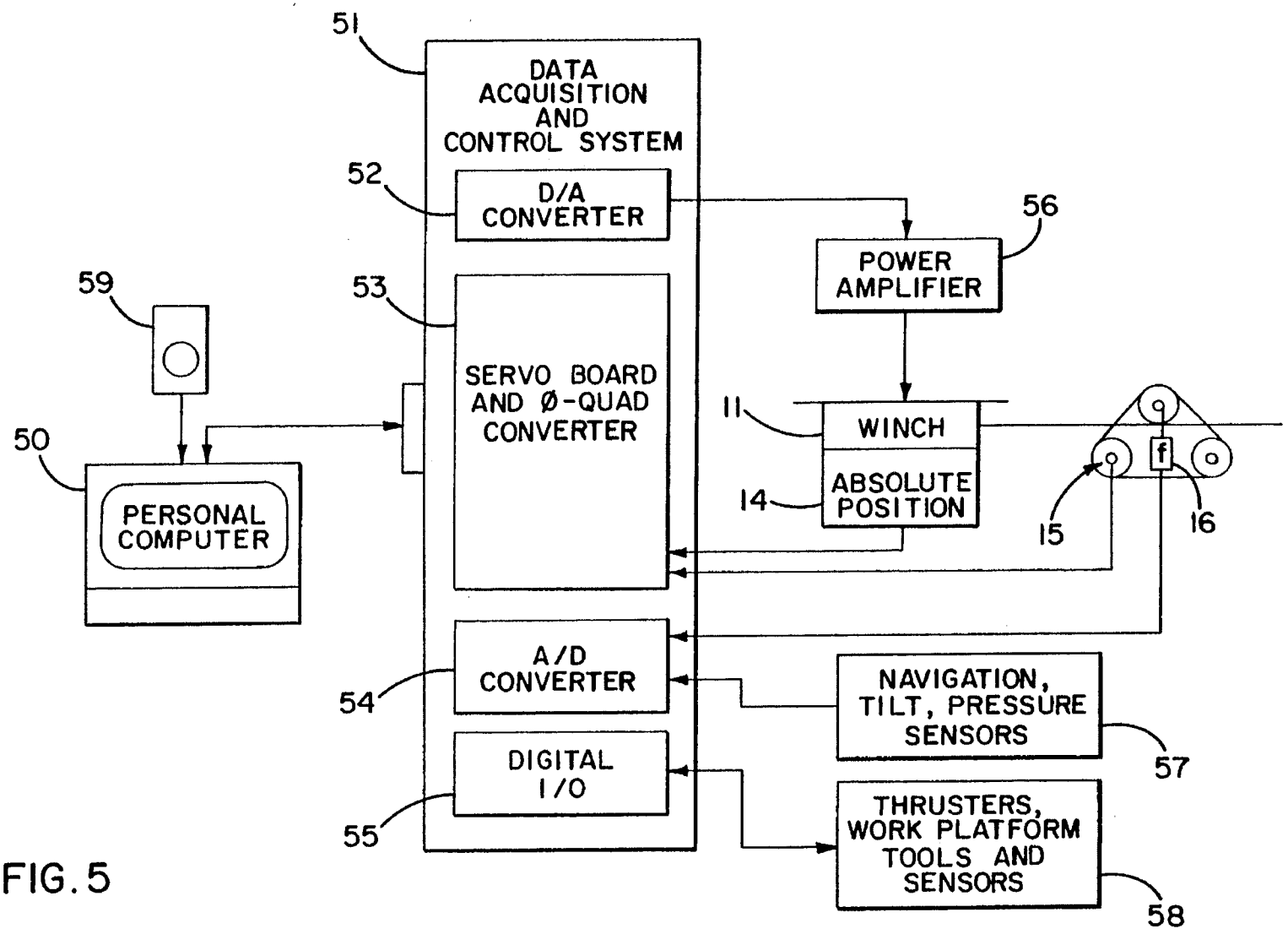
FIG. 5 is a block diagram of a control system for the embodiment of FIG. 1.

FIG. 5 illustrates one example of a control system that can be used in the present invention. This control system is controlled by a processing unit such as a personal computer 50. The computer 50 receives input signals and controls the operation of various equipment through a data acquisition and control system 51, which includes a D/A converter 52, a servo board and phase quadrature converter 53, an A/D converter 54, and a digital I/O port 55. The A/D converter 54 receives analog input signals from various analog devices 57 such as the navigation equipment 19 aboard the support platform 10, the motion sensors 13, and the pressure sensor 18. The digital I/O port 55 is connected to various digital devices 58, such as the thrusters 37 and tools mounted on the work platform 30. The output signals from the absolute position sensor 14 and the incremental encoder 15 are received by the servo board and phase quadrature converter 53. Based on the phase difference between the two output signals from the incremental encoder 15, the phase quadrature converter can determine the direction of movement of each cable 40. Each winch 11 is connected to a power amplifier 56, and the D/A converter 52 generates analog control signals for the power amplifiers 56. The servo board and phase quadrature converter 53 performs feedback control of the winch 11 based on feedback signals from the absolute position sensor 14 and the encoder 15 to maintain the cable 40 at a position specified by a command from the personal computer 50.

The computer 50 can also receive input commands from a human operator through a suitable input device, such as a six-degree-of-freedom joy stick 59 which enables the operator to indicate the direction in which he desires to move the work platform 30.

The control system can be used to perform a variety of different modes of control of the work platform 30. A few examples of possible control modes are described below.

Control of work platform by the joy stick:

When the operator wishes to maneuver the work platform 30, he pushes the joy stick 59 in a corresponding direction. The force applied by the operator on the joy stick 59 indicates the desired rate of movement. The joy stick 59 provides the personal computer 50 with input signals indicating the desired direction and rate, and the computer 50 calculates which of the cables 40 need to be adjusted in length in order to achieve the desired movement. The computer 50 then provides the data acquisition and control system 51 with commands for the appropriate winches 11, and the servo board and phase quadrature converter 53 performs feedback control of the winches 11 indicated by the computer 50 in accordance with the commands from the computer 50.

Automatic control of work platform movement in response to motions of support platform:

The computer 50 receives input signals indicating movement of the support platform 10 from the motion sensors 13 and the navigation equipment 19. Motions such as heave, pitch, and roll of the support platform 10 can be detected by the motion sensors 13, while slower motions such as drift of the surface vessel 20 in ocean currents can be detected by the navigation equipment 19. Based on these input signals, the computer 50 determines whether any of the corners of the upper triangle has deviated from a predetermined reference position. When a deviation occurs, the computer 50 calculates which of the cables 40 need to be adjusted in length in order to compensate for the deviation. The computer 50 generates a command for the winch 11 connected to the cable 40 which needs to be adjusted in length, and the data acquisition and control system 51 performs feedback control of the corresponding winch 11 through its associated power amplifier 56, whereby the position of the work platform 30 is maintained stationary.

It is generally desirable to maintain the tensions in all six cables 40 as uniform as possible. As the winches 11 are taking cable 40 in or out, the computer 50 can monitor the tension in each cable 40 as measured by the tension sensors 16 and adjust the speed of the individual winches 11 to maintain the tensions uniform. In addition, the computer 50 can generate control signals for the control valves for the ballast tanks 34 to adjust the tension in the cables 40.

Programmed control of work platform movement:

During some underwater operations, such as underwater inspection, the work platform moves 30 along a simple path, such as a straight line or a simple curve. For example, if the work platform 30 is being used to inspect an underwater pipeline, it will move along roughly a straight line. If the shape of the path is known in advance, the computer 50 can be programmed to control the winches 11 to automatically move the work platform 30 along the path without the operator having to operate the joy stick 59. Sonar devices or cameras can be attached to the work platform 30 to give the computer 50 real-time feedback.

The operating speed of the winches 11 is preferably sufficiently high for them to take in or pay out the cables 40 fast enough to compensate for the motions of the surface vessel 20 in waves. Typically, the natural periods of motion for a cargo laden vessel are about 6 to 10 seconds for heave, pitch, and roll. Therefore, if the surface vessel 20 is expected to undergo heave motions of approximately 3.3 meters peak to peak in the above range of periods, a winch speed of approximately 60 meters per minute will be able to compensate for heave motions of the surface vessel 20 and maintain the work platform stationary.

In the illustrated embodiments, the control system is mounted on the support platform 10. However, all or part of the control system can mounted on the work platform 30 or elsewhere underwater to enable a diver or other undersea worker in the vicinity of the work platform 30 to control its movement. For example, the joy stick 59 could be mounted aboard the work platform 30.

Figure 6:
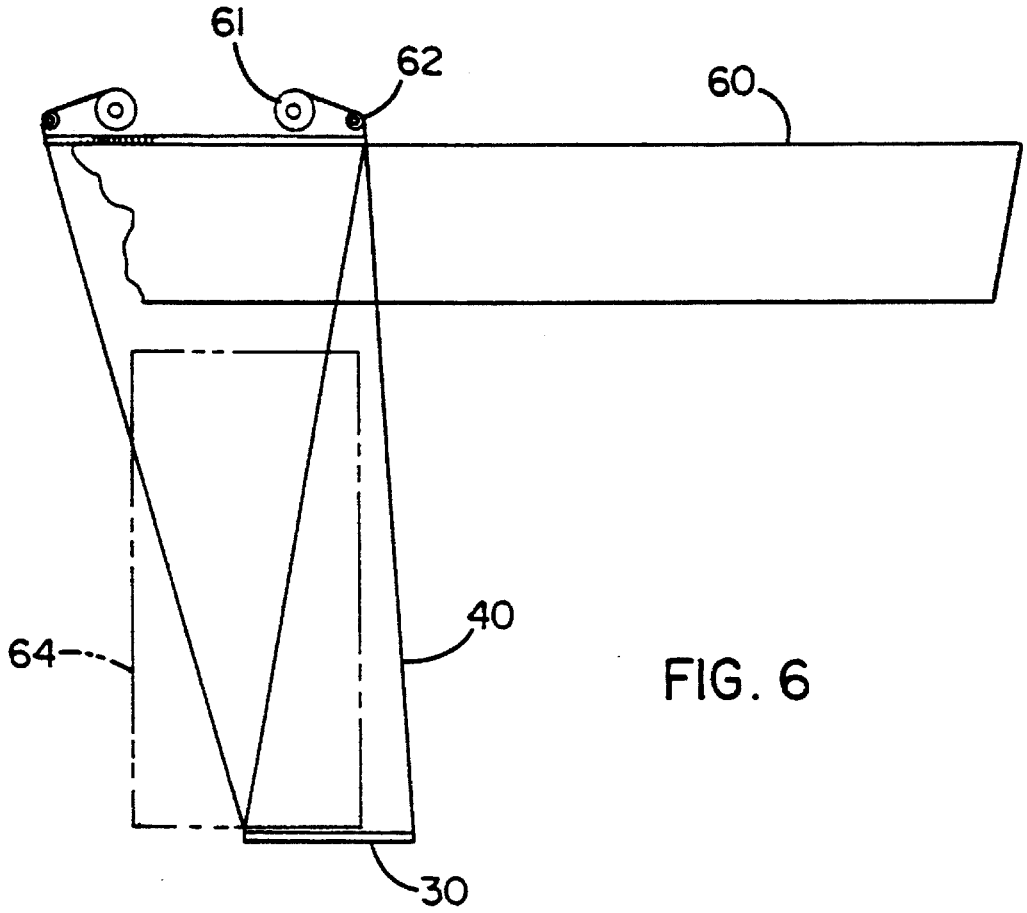
FIG. 6 is a side elevation of another embodiment of the present invention.
Figure 7:
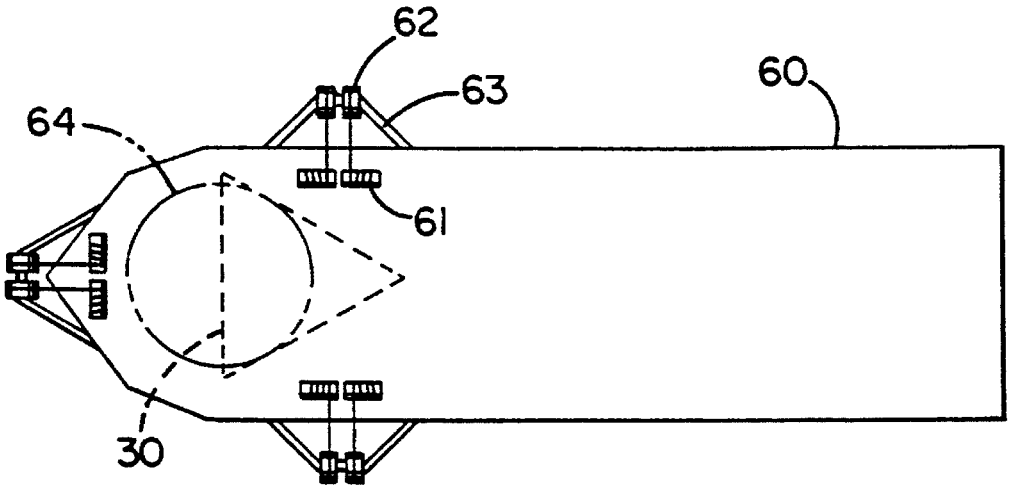
FIG. 7 is a plan view of the embodiment of FIG. 6.

FIGS. 6 and 7 illustrate another embodiment of the present invention in which the support structure for supporting the work platform 30 comprises a conventional surface ship 60 instead of a barge. Winches 61 are mounted on the deck of the ship 60, while pulleys 62 for the cables 40 are mounted on outriggers 63 extending out from the ship's hull. The work platform 30 can be maneuvered from the ship 60 by the six cables 40 with six degrees of freedom within a generally cylindrical work volume 64 extending above the work platform 30. By suitably controlling the winches 61, the work platform 30 can be moved to any point within the work volume 64.

Figure 8:
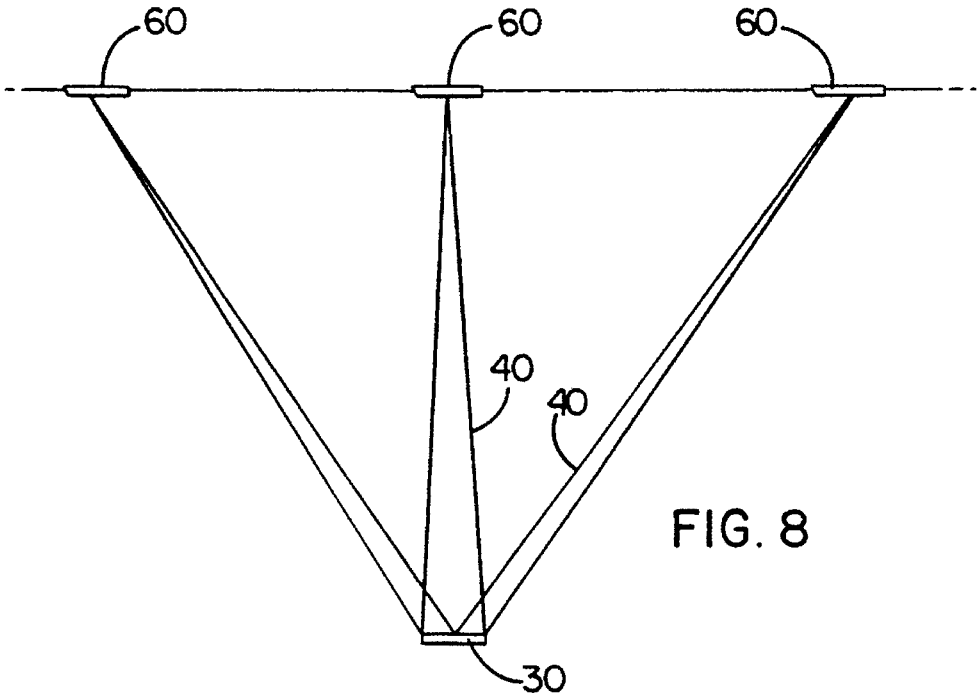
FIG. 8 is a side elevation of another embodiment of the present invention employing a plurality of surface vessels to support the upper ends of the cables.
Figure 9:
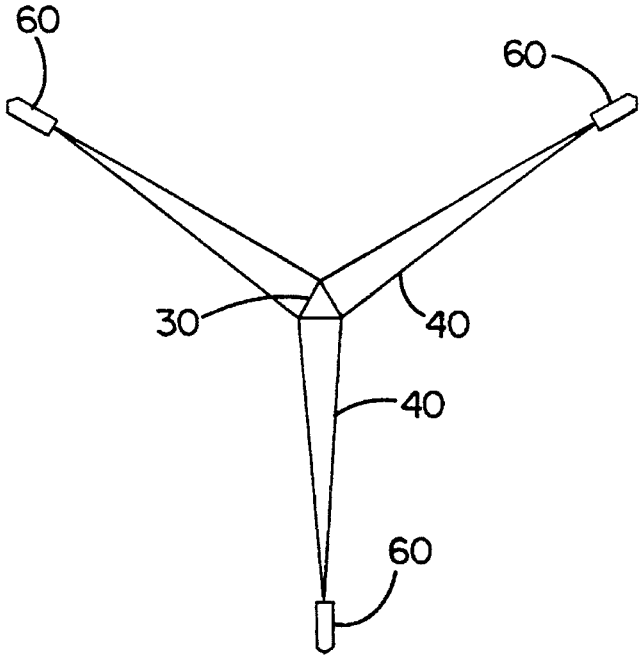
FIG. 9 is a plan view of the embodiment of FIG. 8.
Figure 10:
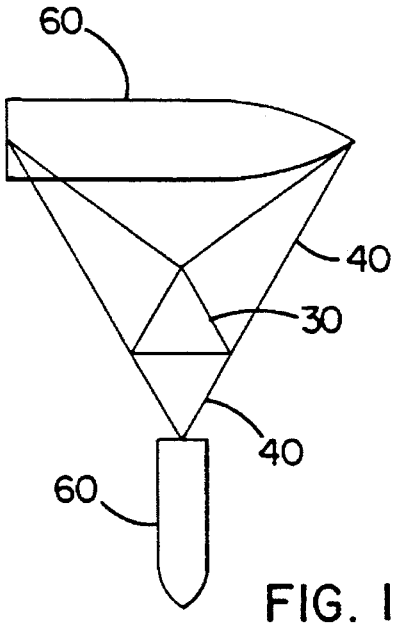
FIG. 10 is a plan view of another embodiment employing two surface vessels to support the upper ends of the cables.

During operation of a support system according to the present invention, the angle $\phi$ between the cables 40 and the vertical is preferably large enough to enable the work platform 30 to be manipulated with 6 degrees of freedom. There is no strict limit on the value of $\phi$, but for optimum stability of the work platform, $\phi$ is preferably not less than approximately 6 degrees. The angle $\phi$ is determined by the depth of the work platform 30 and the dimensions of the support platform 10 and the work platform 30. As the depth of the work platform 30 increases, the size of the support platform 10 must increase accordingly in order to maintain a suitable value for $\phi$. However, there are practical limits to how large a single support platform can be. Therefore, when the depth of the work platform 30 is large, instead of the support structure for the winches comprising a single support platform 30 mounted on a single vessel, the support structure can comprise a plurality of vessels spaced from one another, and the winches can be divided among the plurality of vessels. FIGS. 8 and 9 illustrate an embodiment in which the upper ends of the cables 40 are connected to unillustrated winches aboard three different surface ships 60. If, for example, the three ships 60 are arranged at the corners of an equilateral triangle having sides of 200 meters, the work platform 30 can be supported at a depth of over one kilometer and still maintain a suitable angle between the cables 40 and the vertical. As shown in FIG. 10, it is also possible to support the work platform 30 from two ships 60. The work platform 30 could also be supported by a combination of stationary and floating objects. For example, two of the cables 40 could be connected to winches aboard a stationary tower such as a drill rig, and the remaining two pairs of cables 40 could be connected to winches mounted on two ships, with one pair of cables 40 supported by each ship.

Figure 11:
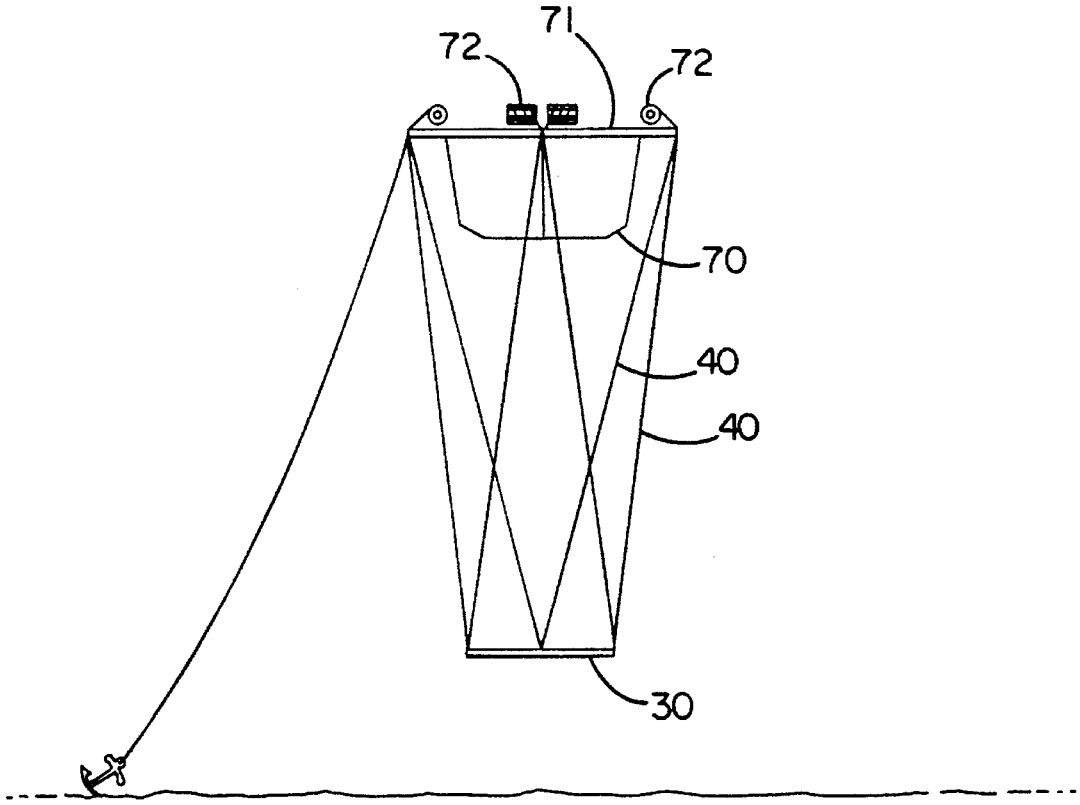
FIG. 11 is an elevation of another embodiment of the present invention in which the support vessel is submerged.

An alternative method of supporting the work platform 30 at great depths is to submerge the support structure. As shown in FIG. 11, for example, a support platform 71 can be mounted on a submerged barge 70 or a submersible, and the work platform 30 can be suspended below the support platform 30 by cables 40 wrapped around winches 72 aboard the support platform 71. The position of the barge 70 can be controlled by various means, such as by lines connected to anchors or by a conventional dynamic positioning system. Since the support platform 71 is submerged, it is less subject to wave actions than a surface vessel and therefore provides a more stable support for the work platform 30, particularly in harsh sea conditions. In addition, the depth of the work platform 30 can be much greater than the working depth of the barge 70 or submersible.

Instead of being suspended from a vessel, the work platform can also be suspended from a free-standing structure such as an offshore drilling rig, and the work platform can be used for rig inspection or subsea work below the rig.

During underwater operations, the work platform 30 may be subjected to lateral or other forces that are not directed vertically downward, such as if the work platform 30 comes into contact with a rigid underwater object. When the forces acting on the work platform 30 are below a prescribed force level, the array of six cables 40 will act like a rigid beam extending between the support platform 10 and the work platform 30, and the array will resist displacement of the work platform 30 in response to the forces. When the forces reach the prescribed level, some of the cables 40 will go slack and the cables 40 will permit the work platform 30 to displace in response to the forces. The prescribed force level at which some of the cables 40 go slack is referred to as the break-away point. It depends upon the tension in the cables 40 and can be calculated from known formulas. Therefore, by adjusting the tension in the cables 40 using the ballast tanks 34, the break-away point can be varied and can be set to a level such that break-away will occur and the work platform 30 will swing freely before the forces are large enough to damage the work platform 30 or the equipment supported by it.

In each of the preceding embodiments, the lengths of the cables 40 are controlled by winches disposed above the work platform 30. However, it is instead possible to mount the winches on the work platform 30. Furthermore, the present invention is not limited to the use of winches, and any device which can vary the length of the cables 40 can be employed. For example, each cable 40 could be incorporated into a block and tackle assembly, each assembly comprising a pair of blocks over which the cable 40 is passed a plurality of times. The length of the cable 40 could then be adjusted by changing the separation between the two blocks by means of a linearly moving actuator, such as a hydraulic ram.

A support system according to the present invention provides many advantages over conventional support systems for work platforms. The array of six cables employed in the above-described embodiments provides a greater degree of maneuverability and more stability than does a crane supporting a work platform by a single cable and enables even a novice operator to precisely maneuver equipment underwater. The support system has a higher payload to weight ratio than a submersible and is less expensive to manufacture. As the work platform can be maneuvered underwater by cables without the use of a propeller or other propulsion device, the work platform can be operated near a lake bottom or the ocean floor without stirring up sediment, unlike a submersible or a legged structure. Therefore, the support system is particularly suitable for salvage operations in which underwater visibility is important and it is desirable not to disturb the work site.

What is claimed is:

1. A support system for supporting an underwater work platform in a controlled underwater position comprising:

a work platform submerged in a body of water;

a support structure capable supported by the body of water above the work platform;

a plurality of cables connected between the support structure and the work platform for supporting the work platform;

motion sensing means associated with the support structure for sensing motion of the support structure in the body of water; and length adjusting means responsive to the motion sensing means for adjusting a length of at least one of the cables in response to the sensed motions of the support structure.

2. The support system according to claim 1 wherein the support structure is totally submerged in the body of water.

3. The support system according to claim 1 wherein the adjusting means comprises a plurality of winches mounted on the support structure, each winch being connected to one of the cables.

4. The support system according to claim 1 wherein the work platform includes a deck having openings through which water can pass as the work platform moves in the body of water.

5. The support system according to claim 1 including a ballast system for adjusting the buoyancy of the work platform.

6. The support system according to claim 5 wherein the work platform comprises hollow members forming a frame, and the ballast system comprises means for inserting a material lighter than water into the hollow members.

7. The support system according to claim 1 including a propulsion device mounted on the work platform for propelling the work platform and the upper platform.

8. The support system according to claim 1 wherein each cable is sloped with respect to a vertical line by at least approximately 6 degrees when no horizontal forces are acting on the work platform.

9. The support system according to claim 1 wherein:

the work platform has three lower support points defining a lower triangle;

the support structure has three upper support points defining an upper triangle; and the cables comprise six cables, two of the cables being connected to the work platform in a vicinity of each of the lower support points and two of the cables being supported by the support structure in a vicinity of each of the upper support points.

10. The support system according to claim 1 wherein the support structure comprises a plurality of vessels floating in the body of water, each of the vessels supporting at least one of the cables.

11. The support system according to claim 1 wherein the motion sensing means comprises means for sensing at least one of roll, yaw, and pitch of the support structure.

12. The support system according to claim 1 wherein the motion sensing means comprises means for sensing at least one of horizontal and vertical movement of the support structure.

13. The support system according to claim 1 further comprising:

tension sensing means for sensing a tension of at least one of the cables; and means for adjusting the buoyancy of the work platform in response to changes in the sensed tension.

14. The support system according to claim 1 wherein the support structure comprises an omnidirectional barge.

15. A support system for supporting an underwater work platform in a controlled underwater position comprising:

a work platform capable of being submerged in a body of water;

a support structure capable of being supported by the body of water above the work platform;

a plurality of cables connected between the work platform and the support structure for supporting the work platform;

tension sensing means associated with at least one of the cables for sensing a tension of the at least one of the cables; and buoyancy adjusting means responsive to the tension sensing means for adjusting buoyancy of the work platform in response to changes in the sensed tension.

16. A support system for supporting an underwater work platform comprising:

a work platform submerged in a body of water and having three lower support points defining a lower equilateral triangle;

a support structure supported by the body of water above the work platform and having three upper support points defining an upper equilateral triangle;

six cables connected between the work platform and the support structure and supporting the work platform, two of the cables being connected to the work platform in a vicinity of each of the lower support points and two of the cables being supported by the support structure in a vicinity of each of the upper support points;

six winches mounted on the support structure, each winch connected to a corresponding one of the cables for adjusting the length of the corresponding cable;

motion sensing means for sensing motion of the support structure in the body of water; and means for operating the winches in response to the sensed motion to adjust the lengths of the cables to compensate for the motions of the support structure.

17. A method for controlling an underwater work platform comprising:

supporting a work platform submerged in a body of water by a plurality of cables connected between the work platform and a support structure disposed above the work platform;

sensing a tension in at least one of the cables; and adjusting the buoyancy of the work platform in response to changes in the sensed tension.

18. The support system according to claim 1 wherein the motion sensing means comprises means for sensing rotation and horizontal and vertical translation of the support structure.

19. The support system according to claim 1 wherein the length adjusting means adjusts the length of at least one of the cables to compensate for sensed rotational motion of the support structure to maintain the work platform substantially stationary.

20. The support system according to claim 19 wherein the length adjusting means adjusts the length of at least one of the cables to compensate for sensed translational motion of the support structure to maintain the work platform substantially stationary.

21. The support system according to claim 1 wherein the length adjusting means adjusts the length of at least one of the cables to compensate for sensed horizontal translational motion of the support structure to maintain the work platform substantially stationary.

22. The support system according to claim 1 wherein the length adjusting means can adjust the position and attitude of the work platform with six degrees of freedom.

23. The support system according to claim 1 including three or more of the cables, wherein the length adjusting means can independently adjust the lengths of the three cables.

24. The support system according to claim 23 wherein the cables are connected to the work platform at three lower support points defining a triangle.

25. The support system according to claim 8 wherein the work platform is kinematically constrained with respect to the support structure in six degrees of freedom.

26. The support system according to claim 9 wherein each of the upper support points is connected to one of the lower support points by one of the cables and is connected to another of the lower support points by another of the cables.

27. The support system according to claim 16 wherein each of the upper support points is connected to one of the lower support points by one of the cables and is connected to another of the lower support points by another of the cables.

28. The support system according to claim 1 wherein the cables are connected to the work platform at three lower support points defining a triangle.

29. The support system according to claim 28 wherein the lower support points define an equilateral triangle.

30. The support system according to claim 9 wherein each of the cables is sloped with respect to a vertical line by at least approximately 6 degrees when no horizontal force is acting on the work platform and the work platform is kinematically constrained with respect to the support structure in six degrees of freedom.

31. A support system for supporting an underwater work platform in a controlled underwater position comprising:

a work platform submerged in a body of water and having three lower support points defining a lower triangle;

a support structure supported by the body of water above the work platform and having three upper support points defining an upper triangle;

six cables connected between the work platform and the support structure and supporting the work platform, each of the upper support points being connected to one of the lower support points by one of the cables and connected to another of the lower support points by another of the cables; and length adjusting means operatively associated with at least two of the cables for independently adjusting the lengths of the at least two of the cables.

32. The support system according to claim 31 wherein the length adjusting means comprises means for independently adjusting the lengths of all six cables.

33. The support system according to claim 31 wherein the length adjusting means adjusts the length of one or more of the cables to move the work platform horizontally while maintaining an attitude of the work platform substantially constant.

34. The support system according to claim 31 wherein the length adjusting means comprises means for adjusting the lengths of at least two of the cables to maneuver the work platform with six degrees of freedom.

35. A support system for supporting an underwater work platform comprising:

a work platform submerged in a body of water and having three lower support points defining a lower triangle;

a support structure comprising a plurality of vessels floating in the body of water above the work platform and having three support points defining an upper triangle, each vessel having at least one of the support points; and six cables connected between the work platform and the support structure and supporting the work platform, each of the upper support points being connected to one of the lower support points by one of the cables and connected to another of the lower support points by another of the cables.

36. A support system for supporting an underwater work platform in a controlled underwater position comprising:

a work platform submerged in a body of water;

a support structure capable supported by the body of water above the work platform;

a plurality of cables connected between the support structure and the work platform for supporting the work platform; and length adjusting means operatively associated with the cables for adjusting lengths of one or more of the cables to move the work platform relative to the support structure with six degrees of freedom.

37. The support system according to claim 36 wherein the length adjusting means adjusts lengths of the cables to maintain all the cables in tension while moving the work platform.

38. The support system according to claim 36 including motion sensing means for sensing rotational and translational motions of the support structure, wherein the length adjusting means adjust the length of one or more of the cables in response to the sensed motions to compensate for the sensed motions and maintain the work platform substantially stationary.

39. A method for controlling an underwater position of an underwater work platform comprising:

supporting a work platform submerged in a body of water by six cables connected between three lower support points on the work platform and three upper support points on a support structure floating in the body of water above the work platform, each of the upper support points being connected to one of the lower support points by one of the cables and connected to another of the lower support points by another of the cables;

sensing motion of the support structure in the body of water; and adjusting the length of at least one of the cables in response to the sensed motion of the support structure to compensate for the sensed motion to maintain the work platform substantially stationary.

40. The method according to claim 39 including adjusting the length of at least one of the cables to compensate for rotation of the support structure.

41. The method according to claim 39 including adjusting the length of at least one of the cables to compensate for horizontal translation of the support structure while maintaining an attitude of the work platform substantially constant.

42. The method according to claim 39 including maintaining all six cables in tension while adjusting the length of at least one of the cables.

43. A support system for supporting an underwater body in a controlled position comprising:

a first body submerged in water;

a second body supported by the water above the first body;

a plurality of tension members extending between lower support points on the first body and upper support points on the second body, each of the upper support points being connected with one of the lower support points by one of the tension members and connected to another of the lower support points by another of the tension members;

a plurality of length adjusting mechanisms each associated with a corresponding one of the tension members for adjusting a length of the corresponding tension member.

44. A support system according to claim 43 including a motion sensor associated with the second body and sensing motion of the second body in the water and a controller responsive to the motion sensor and controlling the length adjusting mechanisms based on the sensed motion to maintain the first body stationary.

45. A support system according to claim 44 including three lower support points defining a triangle on the first body and three upper support points defining a triangle on the second body.

46. A method of controlling a position of an underwater body comprising:

supporting a first body submerged in water by a plurality of tension members connected between a plurality of lower support points on the first body and a plurality of upper support points on a second body floating in the water above the first body, each of the upper support points being connected to one of the lower support points by one of the tension members and connected to another of the lower support points by another of the tension members;

adjusting lengths of a plurality of the tension members while maintaining all the tension members in tension to adjust a position of the first body.

* * * * *